US005397011A

United States Patent [19]

Schäfer

[11] Patent Number: 5,397,011

[45] Date of Patent: Mar. 14, 1995

[54] COLLAPSIBLE CONTAINER WITH SEVERAL CHAMBERS

[75] Inventor: Gerhard Schäfer, Neunkirchen, Germany

[73] Assignee: Fritz Schafer Gesellschaft mit beschränkter Haftung, Neunkirchen-D, Germany

[21] Appl. No.: 141,314

[22] Filed: Oct. 22, 1993

[30] Foreign Application Priority Data

Oct. 23, 1992 [DE] Germany ..... 42 35 851.5

[51] Int. Cl.[6] ..... B65D 51/10; B65D 88/54

[52] U.S. Cl. ..... 220/4.22; 220/553; 220/908; 220/751; 414/180

[58] Field of Search ..... 220/4.22, 908, 553, 220/555, 4.23, 751; 414/180, 181, 182, 185

[56] References Cited

U.S. PATENT DOCUMENTS

| | | | |
|---|---|---|---|
| 2,706,574 | 4/1955 | Clement | 220/4.22 |
| 3,063,591 | 11/1962 | Laginzstra | 220/908 |
| 3,645,419 | 2/1972 | Shorrock | 220/4.22 |
| 4,212,240 | 7/1980 | Lee et al. | 220/908 |
| 4,259,787 | 4/1981 | Minshall et al. | 220/4.22 |

FOREIGN PATENT DOCUMENTS

| | | | |
|---|---|---|---|
| 4134587 | 4/1993 | Germany | 220/4.22 |
| 4319047 | 12/1993 | Germany | 220/4.22 |

*Primary Examiner*—Joseph Man-Fu Moy

*Attorney, Agent, or Firm*—Anderson Kill Olick & Oshinsky

[57] ABSTRACT

A collapsible container for collecting and disposing of valuable materials, salvage material, garbage or the like, including two container sections, such as shells, which are divided along a common closing plane and are connected to one another at their upper side by hinges aligned parallel to the closing plane so that they can be unfolded. Each container section or each shell has, offset to the axis of the hinges, at the upper side hooking elements, with which power-driven hooks of a suspended cross arm, disposed at a crane boom or the like, can be coupled for lifting as well as for controlling the opening and closing process. A bulkhead wall, which is disposed between the opening sides of mutually adjacent container sections or shells, can be locked in its closed position at or in front of the opening side of the one container section or the one shell, and can be converted, in at least one forced-apart position of these container sections or shells by an actuator from the locked position, into an unlocked position. The container section or shell, at which the bulkhead can be locked, contains a partition directed transversely to the bulkhead wall, that each bulkhead wall, and the bulkhead wall consists of two bulkhead wall parts, the dividing joint of which coincides with the partition plane, and both bulkhead wall parts, independently of one another, can be locked together or unlocked from the container section or the shell.

5 Claims, 5 Drawing Sheets

COLLAPSIBLE CONTAINER WITH SEVERAL CHAMBERS

FIELD OF INVENTION

The invention relates to a collapsible container for collecting or for accommodating and disposing of valuable materials, salvaged material, garbage or the like, consisting of two container sections, such as shells, which are divided along a common closing plane and are connected to one another at their upper side by of hinges.

BACKGROUND OF THE INVENTION

EP-B-0 143 197 already discloses a collapsible container of this type wherein each container section or each shell, offset to the axis of the hinges, has at the upper side hooking elements, with which power-driven hooks of a suspended cross arm, disposed at a crane boom or the like, can be coupled for lifting as well as for controlling the opening and closing process, and wherein a bulkhead wall, which disposed between the opening sides of mutually adjacent container sections or shells, can be locked in its closed position at or in front of the opening side of a container section or a shell, and can be converted in at least one forced-apart position of these container sections or shells by an actuator from the locked position into an unlocked position. EP-B-0 143 197 also discloses devices for suspending and unfolding the same, wherein said devices work with a suspended cross arm disposed on crane boom or the like.

In the case of these known collapsible containers, however, the two container sections or shells, which are coupled to one another by hinges, enclose, in their closed position, only a single space, so that these dimensions correspond to the total capacity of the collapsible container. For collecting different types of valuable materials, salvaged material and garbage, such as used glass, old papers or the like, several such collapsible containers must therefore always be set up and disposed of, which requires much space and greater expenditure for labor.

Therefore, to avoid these disadvantages, DE-U-88 05 173 proposes a collapsible container, which is suitable for making it possible to collect and store different materials separately in a relatively confined space and, at the same time, for ensuring a simplified disposal of these different materials. These advantages are achieved by providing a bulkhead wall disposed between the opening sides of mutually adjoining container sections or shells of the collapsible container. In its closed position, said bulkhead wall can be locked at or in front of the opening side of a container section or shell and converted from the locked position into an unlocked position in at least one forced-apart position of this container section or shell. Due to the power-driven opening process, effected with the suspended cross arm, it is possible to open up at first only the collection space of one container section or shell for emptying and only subsequently, as well as at a different place, to unlock the bulkhead wall in front of the opening side of the other container section or the other shell, so that the collection space of this container section or this shell can then also be opened for emptying, but at a different time.

A collapsible container of DE-U-88 05 173 enables two different types of valuable materials, salvaged material, garbage or the like to be collected, stored and subsequently also disposed of closely together but separately from one another.

Frequently, however, the need arises to collect, store and also dispose of at one place more than two types of valuable materials, salvaged material, garbage or the like. This is the case, for example, for the so-called glass recycling, for which white glass, green glass and brown glass have to be handled separately. Consequently, it makes sense to collect and dispose of these three types of glass separately, so that a special sorting process no longer has to be inserted before the reutilization or recycling.

It is therefore an object of the invention to provide a collapsible container of the type discussed above in which, with relatively little additional constructional effort, three different collection chambers can be made available.

SUMMARY OF THE INVENTION

According to the invention, this object is achieved by providing a container of the above-described type in which:

- the container section or the shell, at which the bulkhead wall can be locked, contains a partition directed transversely to the bulkhead wall,
- the bulkhead wall consists of two wall parts, the dividing joint of which coincides with the plane of the partition, and
- the two parts of the bulkhead wall can, independently of one another, be locked with and unlocked from the container section or the shell.

Such a design for the collapsible container makes it possible, due to the power-driven opening process effected with the suspended cross arm, to open up for emptying at first only the collection space of the container section or of the shell, to which no bulkhead wall is assigned. Subsequently and optionally at different places, the two bulkhead wall parts can then be unlocked at different times in front of the opening side of the other container section or the other shell, so that an emptying of the collection spaces therein, mutually separated from one another, takes place at different times.

An important further development characteristic of the invention for a collapsible container with the aforementioned equipment also consists that the container section or shell, in which the partition is contained, has at its upper end three charging openings next to one another, that the charging opening in the middle is provided above the partition and that the charging opening in the middle is supported by a duct-like chute, which extends beyond the depth of the container section or shell and through the cut-outs in the two bulkhead wall parts as far as into the other container section or other shell.

By these means, the advantage is achieved that the different valuable materials, the salvaged material and the garbage or the like can be thrown in from one and the same side of the container.

In deviation from the characteristics of the refinement given immediately above, it is, of course, also conceivable to provide the container section or the shell, which contains the partition, with only two charging openings and to dispose the third charging opening at the opposite side at the upper end of the other container section or other shell. In this case, however, it is necessary to set up the collapsible container so that it is accessible from two opposite sides.

According to a further development of the invention, that an actuator engages each bulkhead wall part, and that the actuators can be operated in two different forced-apart positions of the two container sections or shells.

The actuators can, as per se known, comprise traction mechanism loops. In this connection, however, it is important that traction mechanism loops of different lengths be provided, the two ends of which are anchored at a distance from the connecting hinge at the two container sections or shells of the collapsible container in such a manner that the traction mechanism loops are not under tension in the closed position of the collapsible container but, from specified open positions of the container sections or shells onwards, can be put under tension between the places where they are anchored and the hinge axle of the respective bulkhead wall or lifting-swivelling wall.

Finally, according to the invention, the partition in one section of the container or in one shell consists of sheet metal or a different, relatively narrow-mesh material.

BRIEF DESCRIPTION OF THE DRAWINGS

The objects and features of the invention will become more apparent from the following detailed description of the preferred embodiment with reference to the drawing, in which.

DETAILED DESCRIPTION OF THE PREFERRED EMBODIMENT

Figure 1:
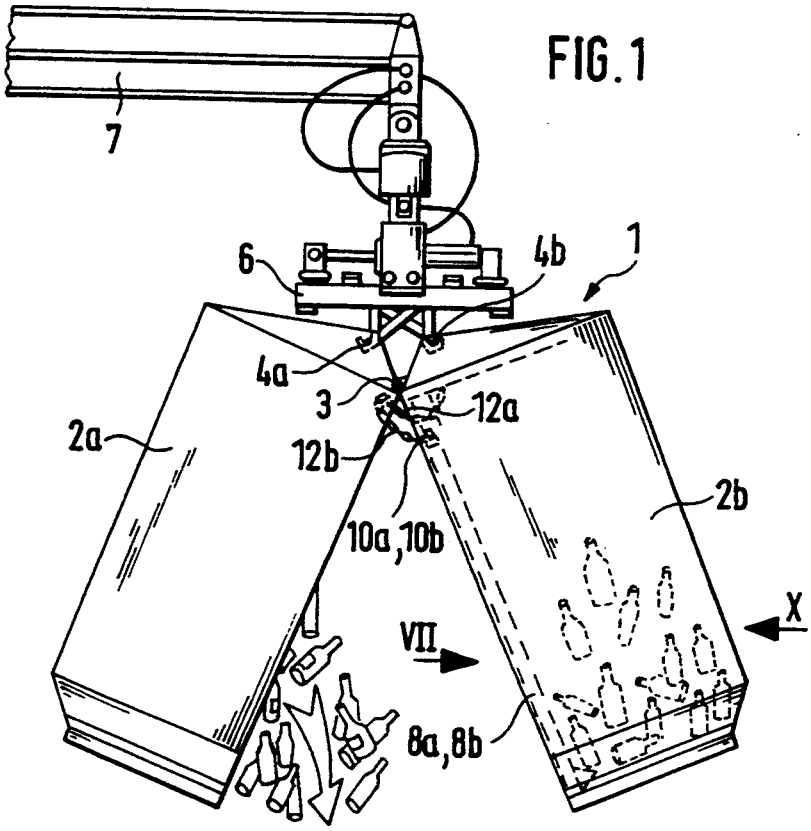
FIG. 1 shows a side view of a collapsible container, which is disposed at a suspended cross arm of a crane boom, in forced-apart or open position for emptying the left section of the container or the left shell.

The drawings shows a collapsible container 1, similar to that used mainly for collecting or accommodating and disposing of valuable materials, salvaged material, garbage or the like. It consists of two container sections or shells 2*a* and 2*b*, which are connected at their upper sides over hinges 3 in such a manner, that the border edges of their mutually facing opening sides can either be placed tightly against one another on a vertical center plane or forced away from one another in wedge-shaped fashion about the hinges 3, as is clearly evident from FIGS. 1 to 5.

Each container section or each shell 2*a* and 2*b* of the collapsible container 1 has at its upper side, at the side and offset in height to the axis of the hinge 3, a hooking element 4*a* or 4*b*, with which a power-drivable hook 5*a* or 5*b* can alternately be coupled or uncoupled. The power-drivable hooks 5*a* and 5*b* are movably guided at a suspended cross arm 6 which, in turn, is carried by a crane boom 7 of a disposal vehicle.

Figure 3:
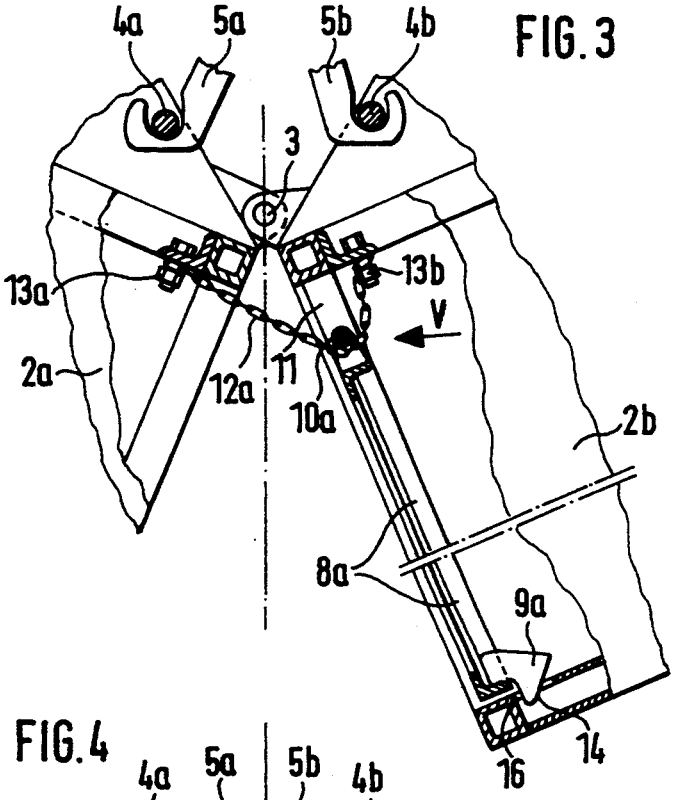
FIG. 3 shows on a larger scale and partially in section the elements essential for the functioning of the collapsible container in their functioning position corresponding to the forced-apart position of FIG. 1.
Figure 4:
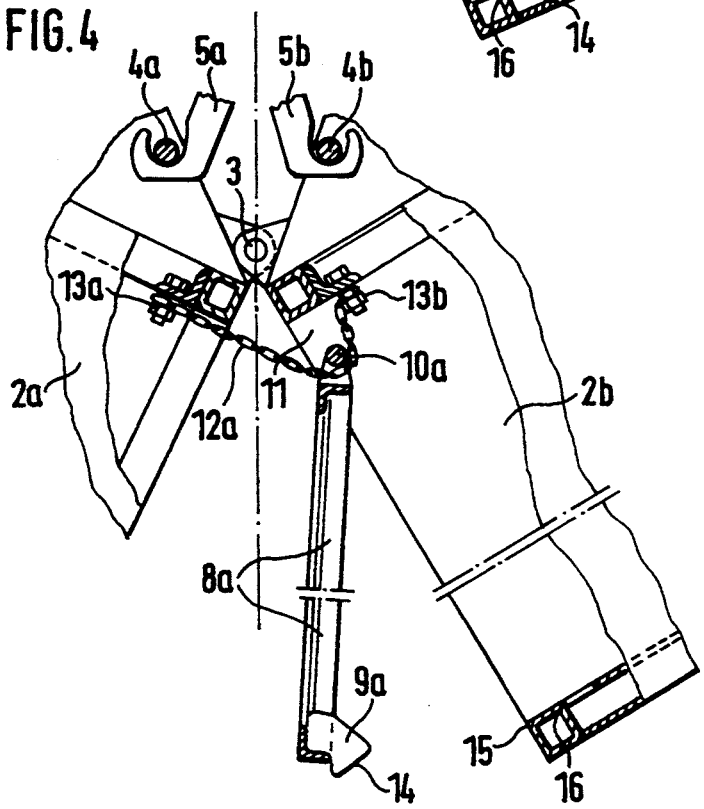
FIG. 4 shows the operating position of the elements essential for the functioning of the collapsible container in the forced-apart position, corresponding to FIG. 2, for emptying a first chamber of the right section of the container or the right shell.
Figure 5:
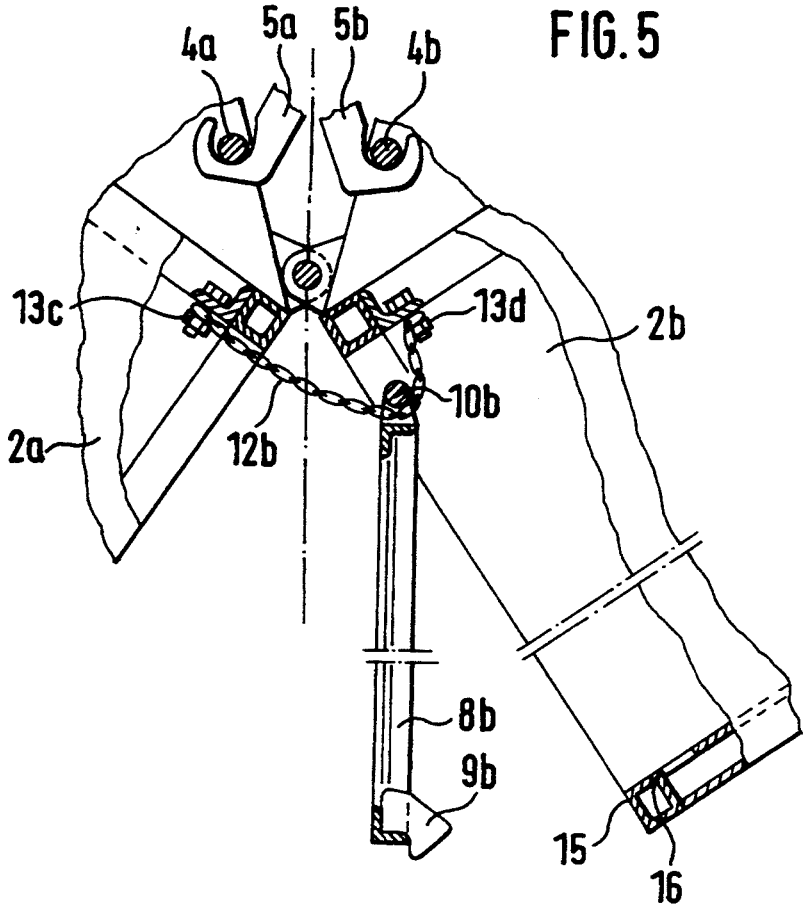
FIG. 5 shows the operating position of the elements essential for the functioning of the collapsible container in a forced-apart position, which is opened further than that of FIG. 2, for emptying a further chamber of the right section of the container or of the right shell.

If the power-driven hooks 5*a* and 5*b* of the suspended cross arm 6 are coupled with the hooking elements 4*a* and 4*b* at both container sections or shells 2*a* and 2*b* of the collapsible container 1, as is shown clearly by FIGS. 3 to 5 of the drawings, then the collapsible container 1 can be raised, on one hand, by the crane boom 7. On the other hand, however, the hooks 5*a* and 5*b* can also be shifted relative to one another by the power drive at the suspended cross arm in such a manner, that the two container sections or shells 2*a* and 2*b* of the collapsible container 1 can necessarily be shifted relative to one another, so that the angle between them, about the axes of the hinges connecting them, necessarily is changed.

Figure 10:
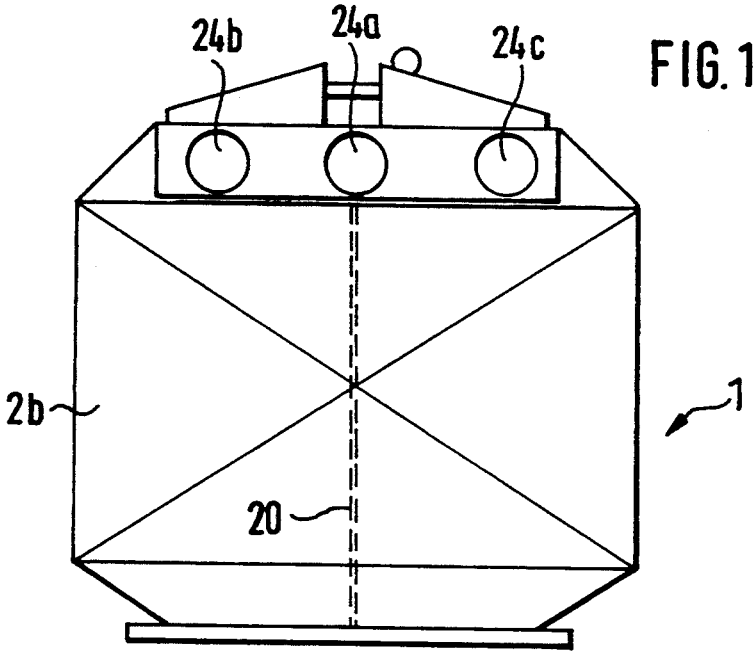
FIG. 10 shows a side view of the collapsible container in the use position, as seen in the direction of arrow X of FIGS. 1 and 2.

In the (not shown) closed basic position of the collapsible container 1, the edges of the openings of the two container section or shells 2*a* and 2*b* lie close to one another on a vertical plane, so that the collapsible container 1 is closed itself and can be set up at a suitable location, as can be seen, for example, in FIG. 10.

Figure 2:
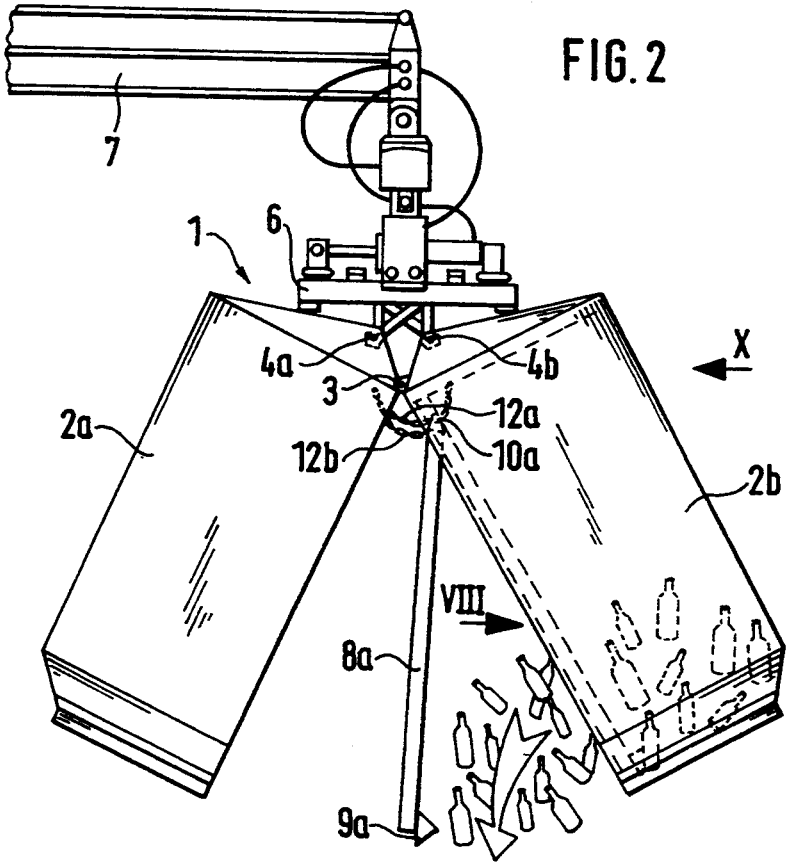
FIG. 2 shows a side view corresponding to that of FIG. 1, in a first forced-apart or open position of the collapsible container, for emptying a chamber of the right section of the container or the right shell.

To open the collapsible container 1, the latter is initially raised with the help of the power-driven hooks 5*a* and 5*b*, which are provided at the suspended cross arm 6 of the crane boom 7. After that, the container sections or shells 2*a* and 2*b* of the collapsible container 1 can be forced apart from one another in wedge-shape fashion. A first forced-apart position is shown in FIGS. 1 and 3, a second forced-apart position is shown in FIGS. 2 and 4, and a third forced-apart position is shown in FIG. 5. In the collapsible container 1, shown in the drawings, an additional bulkhead wall 8 is disposed between the opening sides of the two container sections or shells 2*a* and 2*b*. In its closed position, the additional bulkhead wall 8 is at or in front of the opening side of one of the two container sections or one of the shells 2*a* and 2*b*. In the embodiment shown, the additional bulkhead wall 8 is assigned to the right section of the container or the right shell 2*b* so that it can be locked at or in front of its opening side.

In its locked position, the bulkhead wall 8 assumes an at least approximately parallel position to the opening edge of the container section or the shell 2*b*, as can be seen clearly in FIGS. 1 and 3 of the drawings. A so-called lifting-swivelling wall serves as bulkhead wall 8 and carries, at its lower end, snap-in claws 9, which can, in each case, be locked in behind abutments 16 at the lower end of the opening side of the container section or the shell 2b, as illustrated by FIG. 3.

Figure 6:
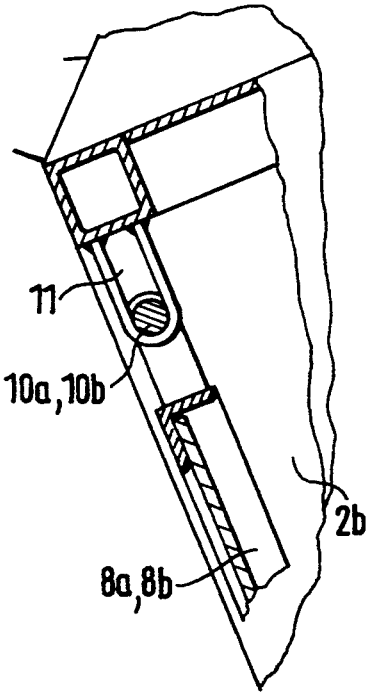
FIG. 6 shows a partial cross-sectional view, on a larger scale, of the region of the collapsible container marked VI in FIG. 3.

The upper end of the bulkhead wall 8, constructed as lifting-swivelling wall, carries a hinge axle 10, which runs in sliding guides 11, which are disposed at the upper end of the container section or the shell 2b and extend approximately parallel to the opening plane of the same, as can be seen in FIG. 6. The sliding guides 11 for the hinged axle can consist of loops, as is also evident from FIG. 6. The length of the sliding guides 11 is such, that they are at least slightly larger than the depth of engagement of the snap-in claws 9 behind the abutments 16.

With lateral distance from the hinges 3, as well as at places, which are constantly below the hinges 3, two traction mechanism loops 12a and 12b, such as steel ropes or chains, are firmly connected with each of the two container sections or each of the two shells 2a and 2b. At the same time, these traction mechanism loops 12a and 12b are also guided around the hinge axle 10 at the upper end of the bulkhead wall 8, as is clearly evident from FIGS. 3 to 5.

Figure 7:
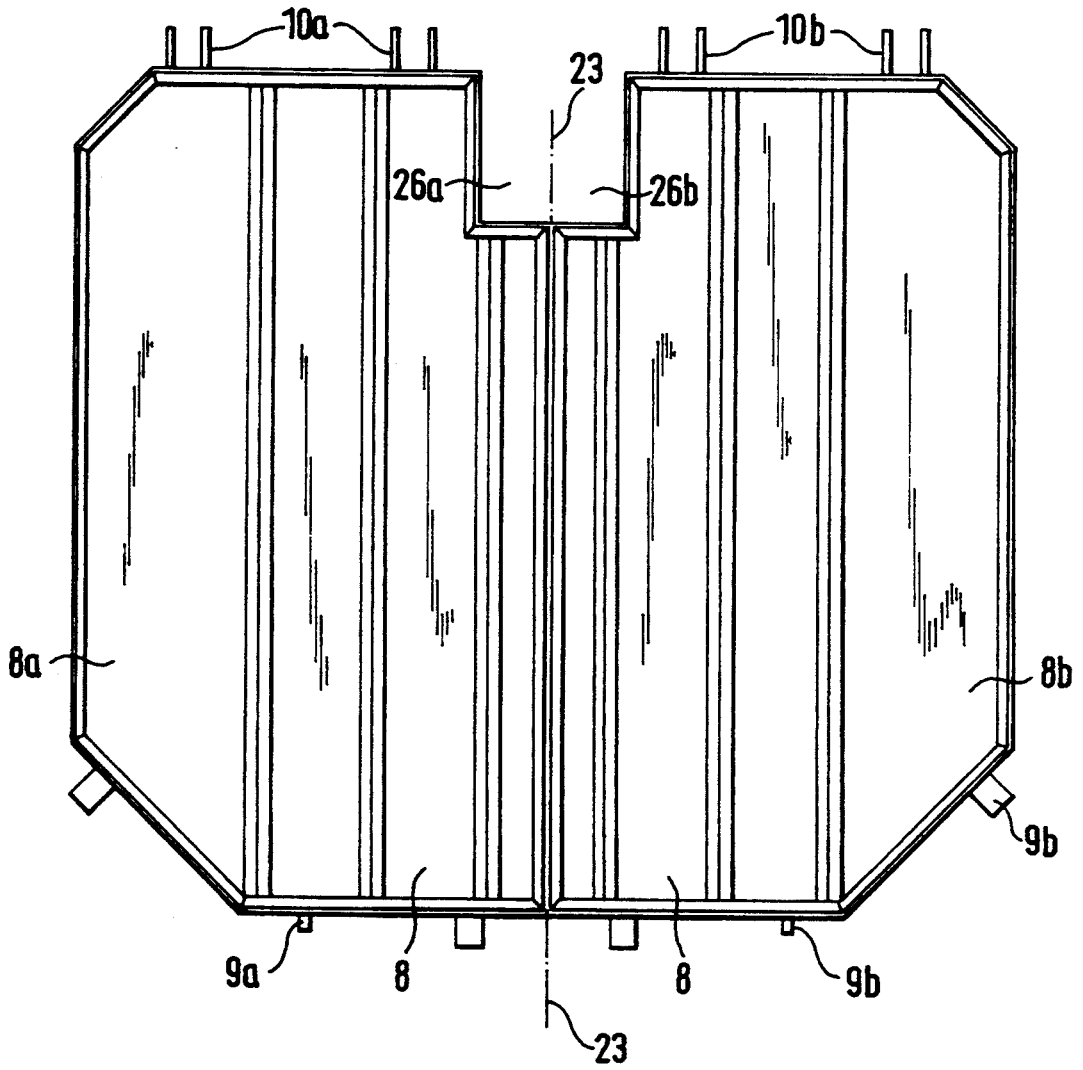
FIG. 7 shows a view in the direction of arrow VII of FIG. 1 of the partition assigned to the right section of the container or the right shell.
Figure 9:
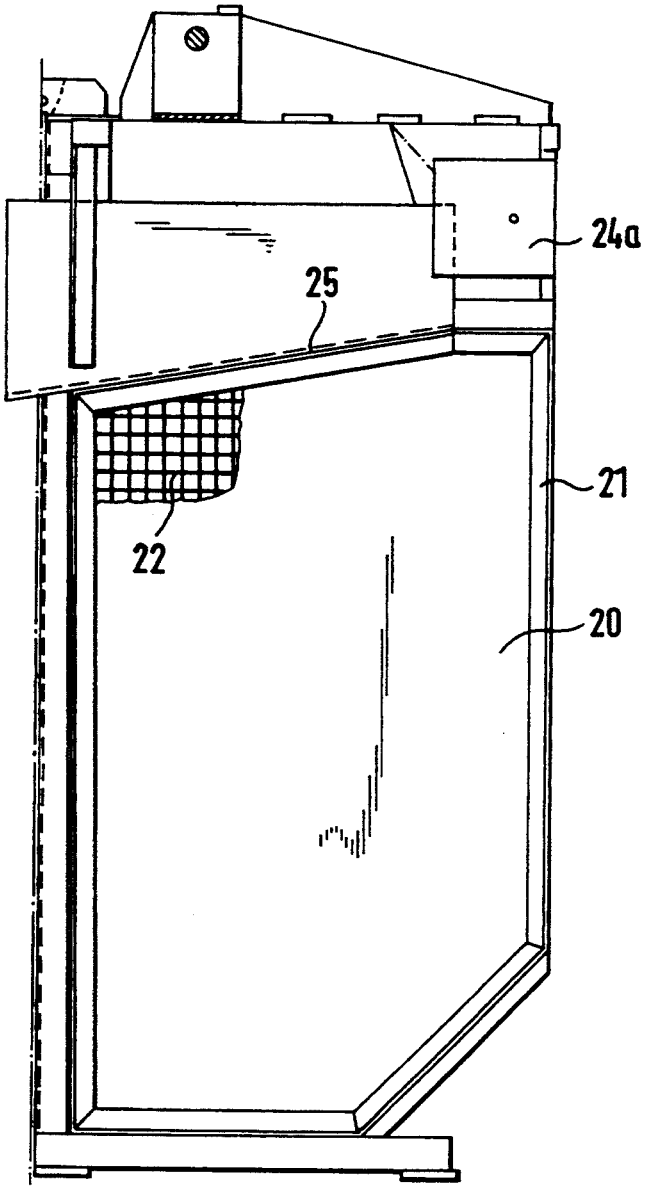
FIG. 9 shows a view in the direction of arrow IX of FIG. 8.
Figure 8:
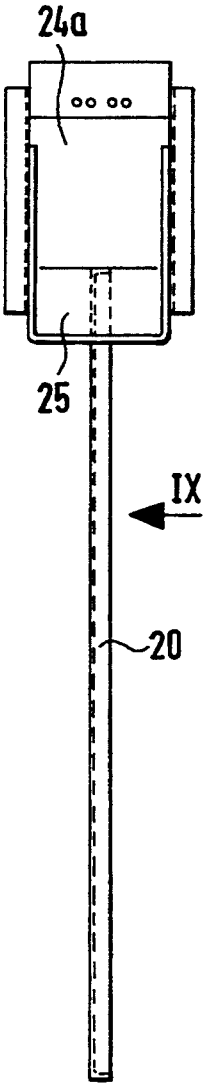
FIG. 8 shows a view in the direction of arrow VIII of FIG. 2 of the partition assigned to the right section of the container or the right shell.

As shown in FIGS. 7 to 9 of the drawing, the right section of the container or the right shell 2b of the collapsible container 1 contains a partition 20 extended transversely to the bulkhead wall 8. In the simplest case, said partition 8 is formed of sheet metal. Preferably, however, it is formed from a sectional frame 21, with an inserted, narrow-mesh wire lattice 22, as is evident particularly from FIG. 9. The partition 20 preferably is disposed so that it divides the container section or the shell 2b into two chambers of equal size. In this connection, it is, however, also important that the bulkhead wall 8 is not constructed in one piece, but consists of two bulkhead wall parts 8a and 8b, which come together in the region of a dividing joint and, for this purpose, have a mirror-image construction, as can be seen from FIG. 7 of the drawings. The two halves or parts 8a and 8b of the bulkhead wall 8 are, of course, equipped with their own snap-in claws 9a and 9b, as well as their own hinge axles 10a and 10b, so that they can exercise their function independently of one another. In this connection, the bulkhead wall part 8a works together over its hinge axle 10a with the traction mechanism loop 12a, while the bulkhead wall part 8b works together over its hinge axle 10b with the traction mechanism loop 12b.

The length of the two traction mechanism loops 12a and 12b is such that these loops are completely relieved of tension in the closed position of the collapsible container 1, that is, in the case of container sections or shells 2a and 2b lying closely adjacent to one another with their opening edges and hang down slack from their two anchoring sites 13a, 13b or 13c, 13d. They can therefore have no effect whatsoever on the hinge axles 10a and 10b of the two bulkhead wall parts 8a and 8b.

When the forced-apart position of the collapsible container 1, which can be seen in FIGS. 1 and 3, is reached, the traction mechanism loop 12a lies against the hinge axle 10a of the bulkhead wall part 8a. However, no tensile force is exerted at the hinge axle 10a. Only when the container sections or shells 2a and 2b of the collapsible container 1 are subsequently forced apart further from the position of FIGS. 1 and 3 into the positions of FIGS. 2 and 4, is the traction mechanism loop 12a placed under tension between its two anchoring sites 13a and 13b and the hinge axle 10a in such a manner, that a tensile force acts on the hinge axle 10a. By these means, the hinge axle 10a is then pulled up along the sliding guide 11, so that the bulkhead wall part 8a participates in this motion. At the same time, the snap-in claws 9a of the bulkhead wall part 8a disengage from the abutments 16 at the container section or shell 2b. Thereupon, the bulkhead wall part 8a, under the action of its own weight, can swing out into the suspended position shown in FIGS. 2 and 4 and, by these means, open up the opening side of the container section or the shell 2b in front of the one chamber defined by the partition 20.

In the forced-apart position shown in FIG. 4 of the drawing, the second traction mechanism loop 12b lies against the hinge axle 10b of the bulkhead wall part 8b, however, without a tensile force being exerted on the hinge axle 10b. Only when the container sections or shells 2a and 2b of the collapsible container 1 have been shifted out of the forced-apart position of FIG. 4 into the position of FIG. 5, in which they are forced further apart, is the traction mechanism loop 12b placed under a tension, which exerts a tensile force on the hinge axle 10b, between its two anchoring sites 13c and 13d and the hinge axle 10b. By these means, the hinge axle 10b is pulled up along the sliding guide 11, so that the bulkhead wall part 8b participates in this motion. The snap-in claws 9b of the bulkhead wall part 8b disengage from the abutments 16 at the container section or shell 2b, with the result that the bulkhead wall part 8b, under the action of its own weight, can also swing out into the suspended position shown in FIG. 5. The consequence of this is that the chamber of the container section or shell 2b, located at the other side of the partition 20, is also opened up.

In the forced-apart position of its container sections or shells 2a and 2b shown in FIGS. 1 and 3, the collapsible container 1 makes possible the emptying of the left container section or the left shell 2a as a whole. By subsequently adjusting the collapsible container to the additional two forced-apart positions, which can be seen, on the one hand, in FIGS. 2 and 4, and on the other, in FIG. 5, the two chambers of the right container section or the right shell 2b, separated from one another by the partition 20, can be opened up for consecutive emptying.

Since the different forced-apart positions for the container sections or shells 2a and 2b of the collapsible container 1 in each case depend on the sliding position of the power-driven hooks 5a and 5b at the suspended cross arm, the possibility exists of providing in the driver cabin of, for example, a waste-disposal vehicle, a display instrument, which signals when the different forced-apart positions are reached. It can then be ensured in a simple manner that the container sections or shells 2a and 2b or the chambers of the collapsible container 1, which are loaded with different valuable materials or with different salvage material, garbage or the like, can also be unloaded in the correct sequence, namely consecutively at different times.

Of course, it is also conceivable to assign to the collapsible container 1 or the suspended cross arm 6 of the crane boom 7 a special power drive, such as a pressure-medium actuator, which can be coupled with the hinge axles 10a and 10b of the bulkhead wall parts 8a and 8b, so that these can be unlocked at different appropriate times for the purpose of unloading chambers of the container section or of the shell 2b lying closer on either side of the partition 20.

In order that the bulkhead wall parts 8*a* and 8*b*, which are in the form of a lifting-swivelling wall, can be brought automatically again into the proper closing and locking position relative to the container section or shell 2*b*, provisions have been made so that the snap-in claws 9*a* and 9*b* of the bulkhead wall parts 8*a* and 8*b* have starting slopes 14 facing the abutments 16. During the closing process of the container sections or shells 2*a* or 2*b*, the starting slopes 14 engage a transverse edge 15 lodged in front of the abutments 16 at the container section or the shell 2*b*. In so doing, they slide up along this transverse edge 15 and consequently necessarily lift the bulkhead wall parts 8*a* and 8*b* until their hinge axles 10*a* and 10*b* rise up into the sliding guides 11 and until the snap-in claws 9*a* and 9*b* can mesh, under the weight of the bulkhead wall parts, with the abutments 16, in order to effect locking there.

A special feature of the collapsible container 1 of the construction described above can be seen in FIGS. 7 to 10. It consists in that the container section or the shell 2*b*, in which the partition 20 has been built, has, at its upper end, three different, adjacent, spaced apart charging openings 24*a*, 24*b*, 24*c*, for different valuable materials or varying salvage material and garbage or the like. In this connection, it is important that the middle charging opening 24*a* is above the partition 20 and supported by a duct-like slide 25 (FIGS. 8 and 9), which extends beyond the depth of the container section or of the shell 2*b* into the other container section or the other shell 2*a* (FIG. 9). To keep the duct-like slide 25 in the container section or shell 2*a* constantly open, the two bulkhead wall parts 8*a* and 8*b* have, at their upper end and adjoining the dividing joint 23—23 in each case, cut-outs 26*a* and 26*b*, which are adapted to the total cross-section of the duct-like slide 25. These cut-outs 26*a* and 26*b*, on one hand, ensure the satisfactory functioning of the two bulkhead wall parts 8*a* and 8*b* for opening and closing the two chambers in the container section or in the shell 2*b*. On the other hand, however, they also ensure that the material, introduced over the charging opening 24*a*, is passed on over the slide 25 in each case reliably into the container section or the shell 2*a*. The charging opening 24*b* leads directly into the left chamber and the charging opening 24*c* directly into the right chamber of the container section of the shell 2*b*. Finally, it should still be mentioned that, under certain circumstances, it is also possible to divide each container section or each shell 2*a* and 2*b* by a partition 20 into two adjacent chambers and, at the same time, to assign a bulkhead wall part to each of these chambers in the two container sections or shells 2*a* and 2*b*. Moreover, the arrangement of the latter must, of course, be such that they can automatically or forcibly and without mutual interference be opened laterally, consecutively and at different forced-apart angles of the container sections or shells 2*a* and 2*b* of the collapsible container 1. This would be possible, for example, owing to the fact that each of the four bulkhead wall parts works together with its own traction mechanism loop and, at the same time, the four traction mechanism loops are dimensioned differently in length so that they can respond only at different forced-apart angles of the two container sections or shells 2*a* or 2*b* and, accordingly, effect unlocking of the bulkhead wall parts consecutively at different times.

What is claimed is:

1. A collapsible container for collecting and disposing of valuable materials, salvaged material, garbage or the like, said collapsible container comprising:

two container sections divided along a common closing plane;

hinge elements arranged at upper portions of said two container sections in a region of the closing plane for connecting said two container sections together at said upper portions thereof, said two container sections having, at the upper portions thereof, hooking elements offset with respect to an axis of said hinge elements and engageable with power-driven hooks of a cross arm suspended at a crane boom to enable lifting as well as opening and closing of said container;

a bulkhead wall arranged between opening sides of said two container sections and adapted to be locked, in a closed position thereof, at the opening side of one of said two container sections having a partition extending transversely to said bulkhead wall; and means for moving said bulkhead wall, in at least one forced-apart position of said two container sections, from a locked position to an unlocked position, wherein said bulkhead wall has two wall parts and joint means for connecting said two wall parts together and arranged in a plane of said partition, said two wall parts being adapted to be locked with and unlocked from said one of said two container parts independently from one another.

2. A collapsible container of claim 1, wherein said one of said two container sections has, at an upper end thereof, three adjacent charging openings of which a middle opening is provided above said partition, wherein each of said two wall parts has a cut-out, and wherein said container further comprises a duct-slide at said middle opening and extending beyond a width of said one of said two container sections through the cut-outs of said two wall parts up to another of said two container sections.

3. A collapsible container as set forth in claim 1, wherein said moving means comprise two actuators for engaging said two wall parts of said bulkhead wall and operable in two different forced-apart positions of said two container sections.

4. A collapsible container as set forth in claim 3, wherein said two actuators comprise, respectively, two traction mechanism loops of different lengths, each of said two traction mechanism loops having two ends anchored to said two container sections at a distance from respective hinge elements at locations such that said two traction mechanism loops are not under tension in a closed position of said container but are tensioned, at a predetermined opening position of said two container sections, between anchoring positions thereof and hinge axle of said two wall parts of said bulkhead wall.

5. A collapsible container as set forth in claim 1, wherein said partition is formed of one of sheet metal and a narrow-mesh lattice held in a frame.

* * * * *